United States Patent [19]

Willeke

[11] 4,177,443

[45] Dec. 4, 1979

[54] THERMAL RELAY AND ELECTRIC RANGE CONTROL UTILIZING THE SAME

[75] Inventor: Steven A. Willeke, Mansfield, Ohio

[73] Assignee: Essex Group, Inc., Fort Wayne, Ind.

[21] Appl. No.: 892,437

[22] Filed: Mar. 31, 1978

[51] Int. Cl.[2] ..... H01H 71/16; H01H 71/22

[52] U.S. Cl. ..... 337/101; 337/53; 337/89; 337/102; 337/324; 337/343; 337/377; 337/378

[58] Field of Search ..... 337/102, 99, 101, 95, 337/100, 89, 91, 377, 378, 53, 120, 343, 324; 361/29, 32

[56] References Cited

U.S. PATENT DOCUMENTS

| | | | |
|---|---|---|---|
| 3,582,853 | 6/1971 | Morris | 337/102 |
| 3,858,139 | 12/1974 | Hunter | 337/102 X |
| 3,858,140 | 12/1974 | Hancock | 337/102 X |

*Primary Examiner*—R. L. Moses
*Attorney, Agent, or Firm*—Lawrence E. Freiburger; Robert D. Sommer

[57] ABSTRACT

A thermal relay construction capable of operating a pair of electrical contacts. The thermal relay includes an electrical heater of the self-regulating PTC type which is mounted upon and thermally coupled directly to a bimetal snap disc so that heat generated by the heater causes the bimetal snap disc to overcenter and operate the electrical contacts. The other electrical connection to the heater is made through a compensating blade which bears against the heater to compensate for ambient temperature effects on the thermal relay. An electric range oven control uses temperature sensitive electrical contacts in conjunction with the thermal relay to control the oven heaters.

8 Claims, 6 Drawing Figures

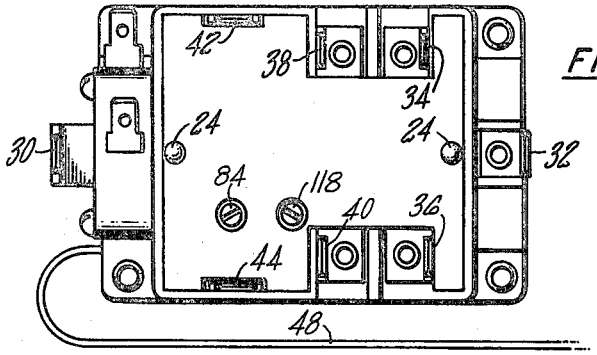
FIG.5
FIG.3
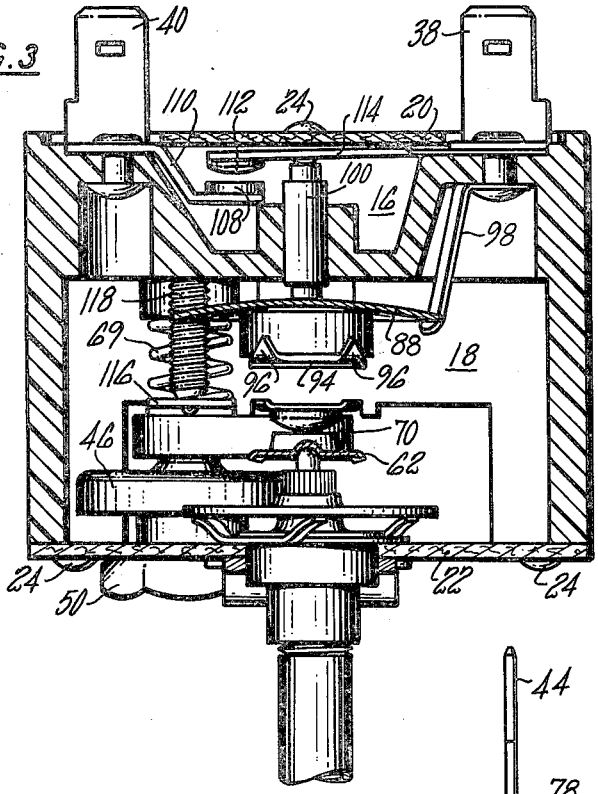
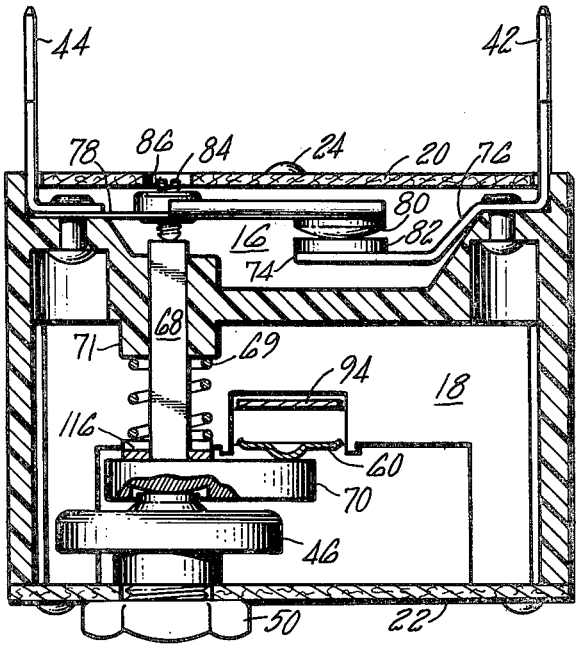
FIG.4

THERMAL RELAY AND ELECTRIC RANGE CONTROL UTILIZING THE SAME

BACKGROUND OF THE INVENTION

In the prior art, time delay relays in which a PTC heater is located in heat transfer relationship with a bimetal snap disc are well known. Typical of such devices is the one shown in U.S. Pat. No. 3,858,139 in which a bimetal disc is located in a cup-shaped member to which the PTC heater is adhesively attached. In the device shown in this patent, one electrical connection to the heater is made by a spring blade biased against the heater and the other connection is made by a second spring blade biased into engagement with the cup-shaped member. The bimetal snap disc is arranged such that it moves a yoke havig two projections thereon which each actuate a switch when the yoke is moved by the bimetal disc.

A number of problems are associated with the aforementioned prior art thermal relay device. Firstly, the thermal coupling between the PTC heater and the bimetal snap disc is dependent on ambient temperature conditions to a greater extent than is desired because of the terminal extending from outside the housing to make electrical contact to the cup-shaped member. Secondly, the thermal coupling between the PTC heater and the bimetal snap disc in the aforementioned prior art device is dependent on the position of the bimetal snap disc to a certain extent. Thirdly, the yoke structure used in the prior art device to actuate a pair of switches is subject to substantial variations in size, and these size variations will result in differences in the operating temperature of the two switches.

SUMMARY OF THE INVENTION

The disadvantages of the prior art thermal relay are overcome by the present invention which provides a thermal relay construction in which an improved thermal coupling between the PTC heater and bimetal snap disc is obtained by mounting the heater element directly against the bimetal snap disc. In addition, the thermal coupling of the thermal relay of the present invention is less affected by ambient temperature conditions because the one electrical connection to the heater is made through the bimetal snap disc rather than by a separate terminal extending from outside the housing as in the prior art. Finally, the thermal relay of the present invention uses two separate actuating pins rather than a yoke with two actuating extensions as in the prior art to actuate the two switches. By using the two separate actuating pins, the problem with prior art yoke structure is substantially overcome because it is possible to determine the optimum length for each pin separately.

BRIEF DESCRIPTION OF THE DRAWING FIGURES

In the course of the detailed description of the invention, mention will be made to the drawing FIGS. in which.

Figure 1:
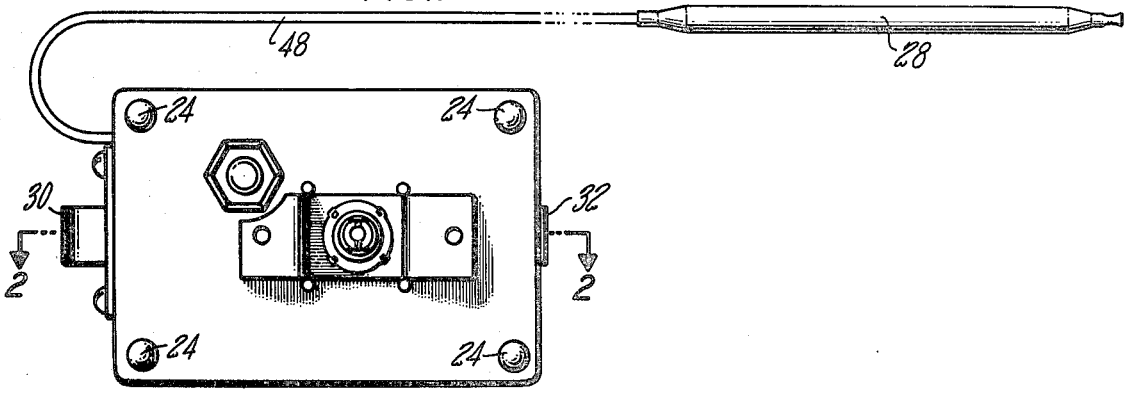
FIG. 1 is an elevational view of an electric range oven control in accordance with the present invention.
Figure 2:
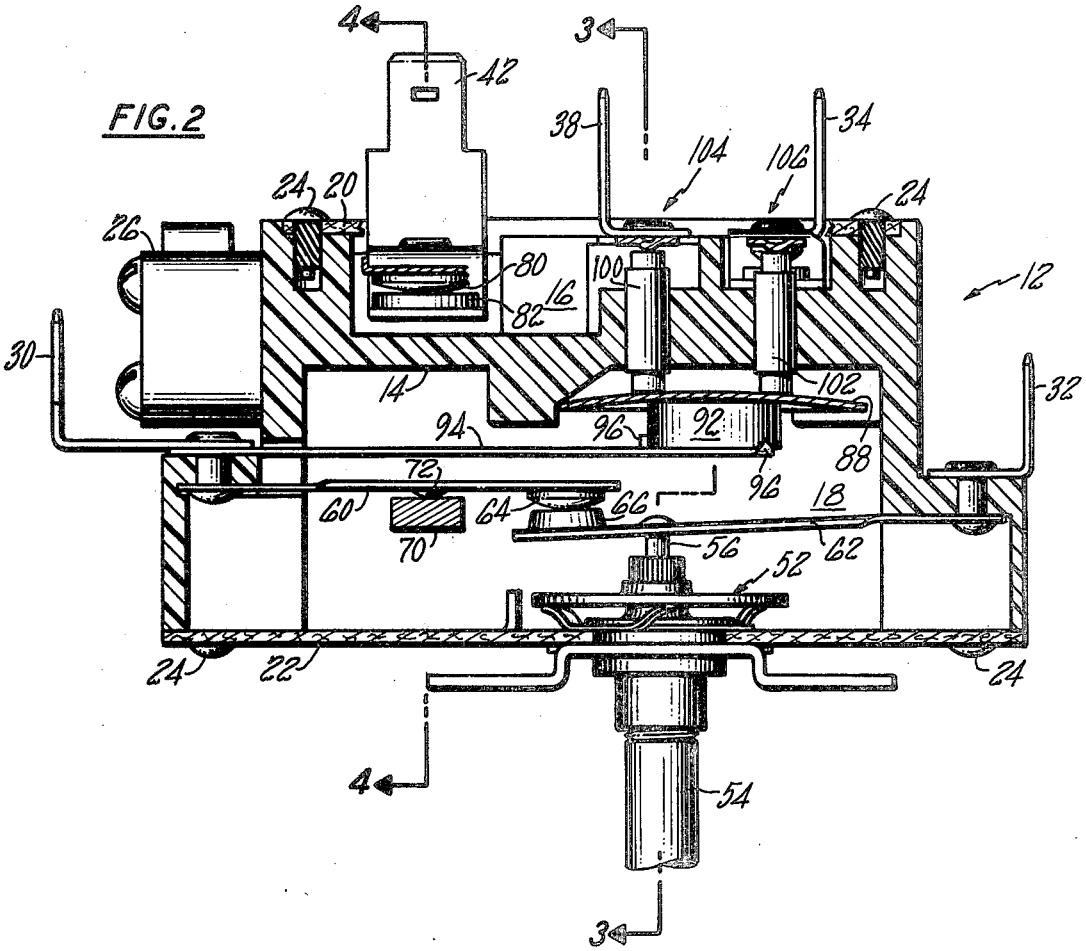
FIG. 2 is a cross sectional view taken along lines 2—2 of FIG. 1.
Figure 6:
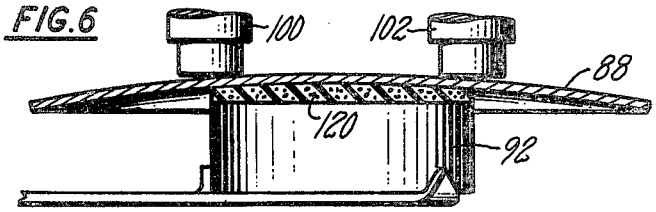

FIGS. 3 and 4 are cross sectional views taken along lines 3—3 and 4—4, respectively, of FIG. 2;

FIG. 5 is an additional elevational view of the electric range oven control of FIGS. 1-4; and FIG. 6 is a cross sectional view showing a modified coupling between the electrical heater and snap disc of the electric range oven control of FIGS. 1-5.

DETAILED DESCRIPTION OF THE INVENTION

Referring to the drawing FIGS. an electric range oven control embodying the principles of the present invention has a housing assembly which includes a central housing section 12 of plastic or other suitable electrical insulating material having an interior wall 14 which serves to divide the housing into upper and lower cavities 16 and 18 respectively. Cavities 16 and 18 are closed off by suitable upper and lower insulating plates 20 and 22, respectively, which are attached to housing section 12 by screws 24 or other suitable fasteners. Also mounted on the central housing section is a snap acting micro-switch assembly 26 which is actuated by a capillary action type thermostatic bulb 28. Inasmuch as the switch 26 does not form a part of the present invention it will not be described in detail. A plurality of electric terminals denoted by reference numerals 30–44 are riveted to the housing at various positions in order to make electrical contact to electrical components situated within housing cavities 16 and 18.

Thermostatic bulb 28 is connected to a conventional diaphragm assembly by a tube 48 which extends through a sidewall of central housing section 12. Diaphragm assembly 46 is suitably secured to lower housing plate 22 by a hex nut 50 in a conventional manner, and since tube 48 is connected to diaphragm 46 in a conventional manner, that particular connection is not illustrated in the drawings. Also mounted on lower plate 22 is a substantially conventional adjusting mechanism 52 including a shaft 54 upon which a knob (not shown) carrying suitable temperature indicia is mounted. Inasmuch as the electrical range control of the invention utilizes a separate switching mechanism to initiate self-cleaning operation, it is necessary that the adjusting mechanism 52 be of the conventional type which controls the oven over the normal operating bake and broil modes. Adjustment mechanism 52, as is conventional in the art, accomplishes its adjustment function by providing an adjusting stud 56 which is moved toward a protracted position as the shaft 54 is moved toward higher desired temperature.

Mounted on the housing section 12 in lower cavity 18 is a pair of elongated contact spring blades 60 and 62 having cooperating electrical contacts 64 and 66, respectively, at their interior ends. Contacts 64 and 66 form a set of main temperature sensitive electrical contacts which control current flow to the electrical heater of a thermal relay which will hereinafter be described. It will be noted that both spring blades 60 and 62 are biased toward plate 22 and adjustment stud 56 bears against the underside of blade 62 such that the position of contact 66 is determined by adjustment mechanism 52.

An elongated actuator member 68 is slidably mounted in the interior wall 14 and is axially aligned in abutting contact with diaphragm assembly 46 such that movement of the diaphragm caused by temperature changes in the environment in which bulb 28 is located, causes actuator 68 to move axially also. The actuator 68 includes an integral lateral extension 70 which extends to a point beneath a dimpled section 72 of switch blade 60 such that movement of actuator 68 away from plate 22 causes blade 60 to move away from blade 62 to break contacts 64 and 66. A spring member 69 situated coaxially around shaft 68 between a boss 71 on wall 14 and actuator extension 70 biases the actuator toward diaphragm 46.

A pair of normally closed auxiliary contacts are mounted in cavity 16 and include a fixed contact 74 mounted on a bracket extension 76 of terminal 42 and a resilient spring blade 78 riveted to terminal 44. The operating point of auxiliary contacts 80 and 82 which are mounted on spring blade 78 and bracket extension 76, respectively, is adjusted by a threaded adjustment screw 84 carried by spring blade 78 aligned axially with actuator 68. Access to adjustment screw 84 is provided through an aperture 86 in the cover plate. Typically, auxiliary contacts 80 and 82 are designed to operate an auxiliary heater during a self clean cycle of an electric oven, and accordingly are adjusted to open at approximately 900° F. If the control is to be used in other applications, it will be clear to those skilled in the art that the operating point of the auxiliary contacts can be varied by using actuations of different length.

Also situated in housing cavity 18 is a thermally sensitive snap disc 88 that is shown in the drawings in its normal unheated position and is effective, when heated to a predetermined temperature, to change from a concave to a convex configuration with a snap action. Such snap discs are readily available and are generally constructed of bimetal. The peripheral edge of snap disc 88 is held against an integral seating surface on the housing wall 14, such that a change from the normal unheated position shown in the drawings to an opposite position of concavity results in axial movement of the center of disc 88.

A disc shaped positive temperature coefficient heater 92 is biased into initmate thermal and electrical contact with snap disc 88 by a spring blade 94 mounted upon housing section 12 at terminal 30. It will be seen that disc shaped heater 92 is held on spring blade 94 by three tabs 96 struck out from the blade. Depending upon the ambient temperature range in which the control housing is to be located, it might be necessary to compensate for ambient temperature effects on snap disc 88. This can be accomlished by forming spring blade 94 from thermally sensitive material such as bimetal or compound bimetal.

As best shown in FIGS. 2 and 3, the electrical connections to heater 92 are made by spring blade 94 on the one side and snap disc 88 on the other side. In addition, as shown in FIG. 3 an electrical connection between bimetal snap disc 88 and electrical terminal 38 is made by a leaf spring member 98 which is riveted to the housing along with terminal 38 and biased against the edge of snap disc 88.

A pair of contact actuating pins 100 and 102 are mounted for slidable movement in wall 14 and are situated on the upper side of snap disc 88 such that movement of the snap disc is translated to a pair of normally closed switch mechanisms 104 and 106, respectively, which are both located in cavity 16. Switch mechanism 104 includes a fixed contact 108 mounted on a bracket extension 110 of terminal 40 and a movable contact 112 mounted at the end of a resilient spring blade 114 suitably riveted to terminal 38 and leaf spring contact 98. Spring blade 114 is biased so that contacts 108 and 112 are normally in engagement. Switch mechanism 106 is identical to switch mechanism 104 and is accordingly not shown in the drawings.

As shown best in FIGS. 2 and 3 an operating lever 116 connected with microswitch 26 is situated to be moved by actuator 68 so that the microswitch 26 is also operated by the actuator 68 in addition to the main contacts and the auxiliary contacts. The operating point of microswitch operating lever 116 is adjusted by an adjusting screw 118 threaded through wall 14 and situated against the operating lever.

In the embodiment of FIGS. 1–5 the thermal and electrical coupling between snap disc 88 and heater 92 is accomplished by biasing the heater into engagement with the snap disc. If an improved thermal coupling is needed, an electrically and thermally conductive gasket 120 may be situated between the heater 92 and snap disc 88 as shown in FIG. 6. Preferably, the gasket 120 is constructed of a mixture of a curable, resilient, compressible resin and a plurality of metallic conductive particles. Suitable materials for the gasket 120 are silicone rubbers and silver coated copper particles. The silicone rubber is prepared and cured in accordance with the manufacturers's directions except that, prior to curing, the metallic particles are added in sufficient quantity to make the finally cured gasket electrically and thermally conductive. It is possible to add a quantity of electrically conductive particles which results in a gasket which is electrically and thermally conductive only when compressed, and since the gasket 120 should always be electrically and thermally conductive, care must be exercised to ensure that a sufficient quantity of electrically conductive particles are dispersed within the resin.

From the above description of the electric range control it is believed its operation will be clear to those skilled in the art. However, for sake of clarity a brief operation description will be given. Initially, under bake or broil conditions main contacts 64 and 66 will be open and will be closed as adjustment mechanism 54 is rotated to the desired operating temperature. Closure of main contacts 64 and 66 will complete a circuit to heater 92 which may be traced as follows: terminal 32, spring blade 62, main contacts 66 and 64, spring blade 60, spring blade 94, heater 92, snap disc 88, spring leaf contact 98 and terminal 38. Thus, whenever main contacts are closed a circuit will be completed to heater 92 which will heat snap disc 88 and cause it to overcenter. As a result, switch mechanisms 104 and 106 which control the oven heaters will be closed a short time after the main contacts have closed. It will be clear, therefore, that the combination of the main contacts 64 and 66, heater 92, snap disc 88 and switch mechanisms 100 and 102 forms a thermal time delay relay As the oven continues to heat, actuator 68 will continue to be moved away from plate 22 and will eventually open main contacts 64 and 66 to deenergize heater 92 and allow it to cool. While the heater 92 cools, the disc will cool also and will eventually return to its normal unheated position to open switch mechanisms 104 and 106 so as to deenergize the oven heaters.

While the oven is operating in either the bake or broil mode, auxiliary contacts 80 and 82 which control current flow to an auxiliary heater used in self clean mode will remain closed, but the auxiliary heater will not be energized because an external control circuit prevents its energization except in the self clean mode. In the self clean mode, current flow to electrical heater 92 is provided by an external control circuit through terminal 30. Eventually, when the oven reaches the desired self cleaning temperature, actuator 68 will open the auxiliary contacts. The cycle will continue until the external self clean circuit is deenergized.

What is claimed is:

1. A thermal relay comprising:

a housing;

a thermally responsive snap disc situated in said housing;

an electrical heater mounted directly upon said thermally responsive snap disc;

temperature compensating means acting upon said thermally responsive snap disc through said electrical heater;

electrical contact means situated in said housing; and contact operating means for mechanically coupling said snap disc and electrical contact means.

2. The thermal relay as claimed in claim 1, wherein said electrical heater is a self heating positive temperature coefficient thermistor.

3. The thermal relay as claimed in claim 1, wherein: an electrically and thermally conductive gasket is situated between said heater and said snap disc.

4. The thermal relay as claimed in claims 1 or 3 wherein the electrical connection to said electrical heater includes said temperature compensating means and said snap disc.

5. The thermal relay as claimed in claim 1, wherein said electrical contact means comprises a pair of fixed contacts on said housing and a pair of cooperating movable contacts on said housing, and wherein said contact operating means comprises a pair of operating pins situated directly on said snap disc.

6. The thermal relay as claimed in claim 1 further comprising:

temperature sensitive electrical contacts in said housing, said temperature sensitive contacts controlling power supplied to said electrical heater.

7. A temperature sensitive electrical control, comprising:

a housing;

a temperature sensitive actuator mechanism;

a thermally responsive snap disc mounted in said housing;

an electrical heater mounted directly upon said thermally responsive snap disc;

an electrical switch mounted in said housing and operated by said snap disc;

main electrical contacts mounted in said housing and operated by said temperature sensitive actuator, said main electrical contacts being connected to said electrical heater so as to control electrical current flow thereto; and auxiliary electrical contacts mounted in said housing and operated by said temperature sensitive actuator at a higher temperature than said main electrical contacts.

8. The temperature sensitive electrical control as claimed in claim 7, further comprising:

an ambient temperature compensating bimetal blade urging said electrical heater against said snap disc; and the electrical connections to said electrical heater being made through said compensating bimetal blade and snap disc.

* * * * *